United States Patent [19]

Auchapt et al.

[11] Patent Number: 4,482,343

[45] Date of Patent: Nov. 13, 1984

[54] APPARATUS FOR DISSOLVING A POWDER IN A LIQUID SOLVENT

[75] Inventors: Pierre Auchapt, Bagnols; Aimé Ferlay, Laudun, both of France

[73] Assignee: Commissariat a l'Energie Atomique, Paris, France

[21] Appl. No.: 465,612

[22] Filed: Feb. 10, 1983

[30] Foreign Application Priority Data

Feb. 10, 1982 [FR] France ..... 82 02168

[51] Int. Cl.[3] ..... B04B 11/00

[52] U.S. Cl. ..... 494/56; 366/227

[58] Field of Search ..... 494/13, 14, 56, 58, 494/59, 63, 66, 85; 366/101, 144, 225, 227, 230, 231, 310, 320, 338, 339

[56] References Cited

U.S. PATENT DOCUMENTS 2,146,716 2/1939 Bennett .
3,254,045 5/1966 Sinclair ..... 366/144
3,338,560 8/1967 Katzer ..... 366/101
3,759,491 9/1973 Pfeuffer .

FOREIGN PATENT DOCUMENTS 417666 8/1925 Fed. Rep. of Germany .
526278 5/1931 Fed. Rep. of Germany .

*Primary Examiner*—Robert W. Jenkins
*Assistant Examiner*—Arthur D. Dahlberg
*Attorney, Agent, or Firm*—Dennis P. Clarke

[57] ABSTRACT

An apparatus for dissolving a powder in a liquid solvent, wherein it comprises a vertically axes rotary bowl, means for introducing the powder and the liquid solvent into the bowl, and a fixed cylindrical member arranged coaxially within the bowl and having on its outer face at least one first helicoidal ramp oriented with respect to the bowl rotation direction in such a way that it ensures the raising of the solution up to means ensuring the removal thereof from the bowl.

10 Claims, 3 Drawing Figures

APPARATUS FOR DISSOLVING A POWDER IN A LIQUID SOLVENT

BACKGROUND OF THE INVENTION

The present invention relates to an apparatus for dissolving a powder in a liquid solvent. More specifically the invention relates to an apparatus in which the powder, the solvent and the solution formed are centrifuged in order to permit the optionally continuous extraction of a substantially powder-free solution.

The methods used hitherto for dissolving a powder in a liquid solvent generally produce agitation, boiling or an evolution of gas in uncontrolled form, which tend to disperse the powder in the solution. It is difficult to draw off a powder-free solution in a continuously operating static dissolver.

BRIEF SUMMARY OF THE INVENTION

The invention relates to an apparatus for dissolving a powder in a liquid solvent making it possible to extract a substantially powder-free solution.

The present invention therefore specifically relates to an apparatus for dissolving a powder in a liquid solvent, wherein it comprises a vertically axed rotary bowl, means for introducing the powder and the liquid solvent into the bowl, and a fixed cylindrical member arranged coaxially within the bowl and having on its outer face at least one first helicoidal ramp oriented with respect to the bowl rotation direction in such a way that it ensures the raising of the solution up to means ensuring the removal thereof from the bowl.

As a result of the centrifugal effect obtained by rotating the bowl, the undissolved powder which is denser than the solution, is located in the immediate vicinity of the wall of the bowl, so that the solution in the vicinity of the outer wall of the fixed cylindrical member is substantially free of powder. Moreover, the helicoidal ramp formed on the outer surface of the cylindrical member makes it possible to automatically raise the solution up to the removal means. In more general terms, the energy transmitted by the bowl to the powder, solvent and solution makes it possible to appropriately position the liquid flows for stirring, wetting the powder, degassing and raising the solution.

According to a first constructional variant of the invention, the means for removing the solution from the bowl comprise an overflow within said member and into which issues the upper end of the first helicoidal ramp, and a central pipe integral with the bowl and downwardly extending the overflow within the cylindrical member.

According to a second constructional variant of the invention, the means for removing the solution from the bowl comprise an overflow integral with said bowl and flush with the first helicoidal ramp, whilst issuing into an annular collector extended by at least one discharge line, the collector and the line being formed in an outer enclosure supporting the bowl.

According to a first embodiment of the invention, able to use one or other of the above two variants, the powder is continuously introduced at the upper open end of the bowl, between the latter and the cylindrical member, the means for introducing the powder comprising a second helicoidal ramp formed on the outer face of the cylindrical member, mainly above the first helicoidal ramp and oriented with respect to the rotation direction of the bowl in such a way as to ensure the descent of the powder.

According to a second embodiment of the invention which can also be used with one or other of the two aforementioned variants, soluble boxes containing the powder are periodically introduced at the upper open end of the bowl, the means for introducing the powder comprising a recess formed in the cylindrical member.

When this latter embodiment is combined with the first variant, the vertical recess is displaced with respect to the axis of the bowl, so as to extend on the side of said central pipe, the vertical recess communicating with the annular space defined between the bowl and the cylindrical member by openings formed in the latter.

However, when this second embodiment is combined with the second variant, the vertical recess is positioned coaxially relative to the bowl and communicates with the space defined between the bowl and the cylindrical member by recycling openings formed in the latter.

In order to increase the dissolving speed, means for heating the solution may optionally be housed in the cylindrical member. In the same way, means for cooling the gases released during dissolving may be housed in the cylindrical member to ensure that these gases entrain no corrosive matter into the gas removal circuit.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
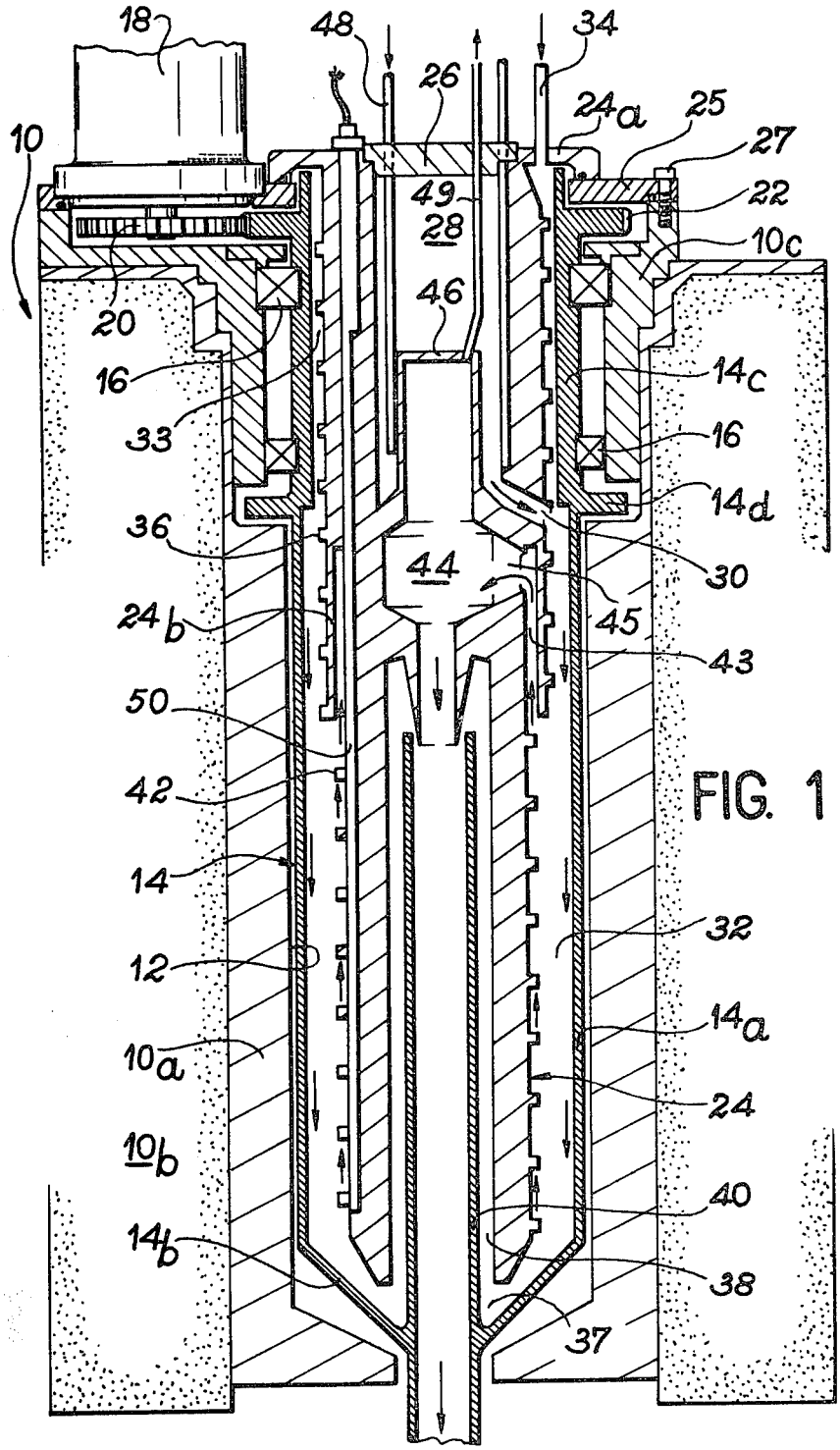
FIG. 1 a diagrammatic longitudinal sectional view of a centrifugal dissolving apparatus constructed according to the invention and in which the powder is supplied continuously.
Figure 2:
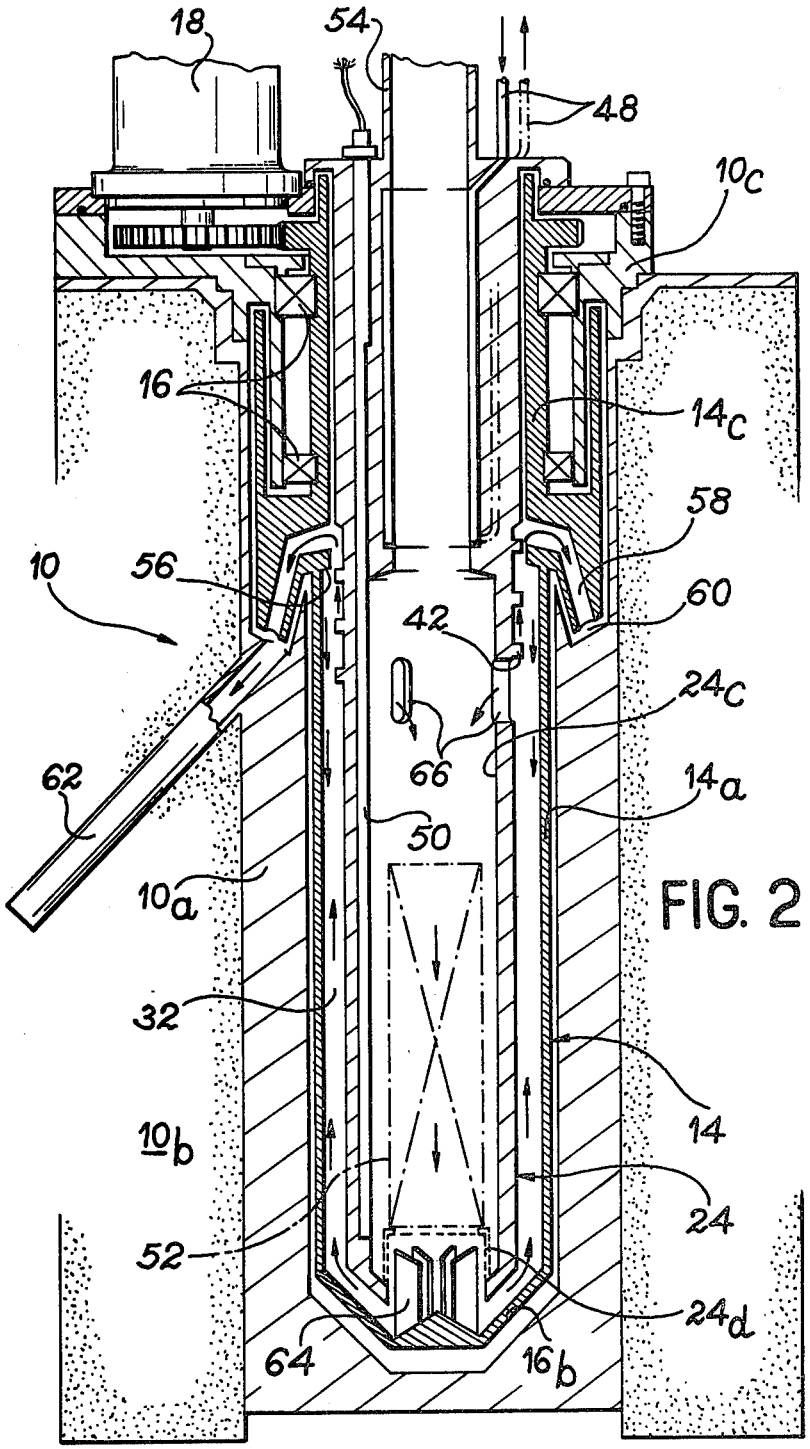
FIG. 2 a sectional view comparable to FIG. 1 showing a second embodiment of the invention in which the powder is supplied periodically in the form of soluble boxes containing said powder.
Figure 3:
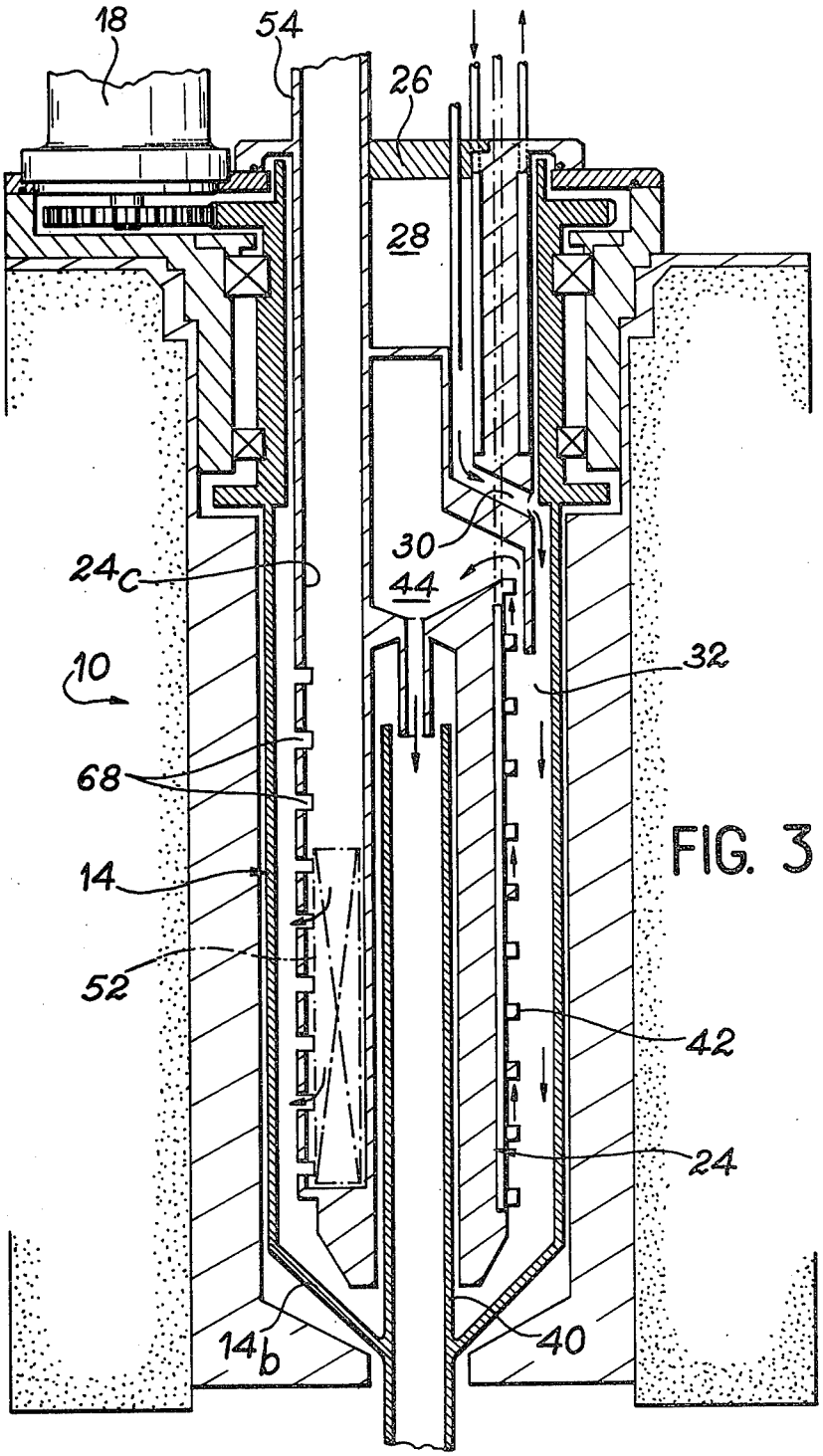
FIG. 3 a diagrammatic sectional view comparable to FIGS. 1 and 2, illustrating a variant of the apparatus of FIG. 2.

The embodiments of the invention shown in FIGS. 1 to 3 are particularly suitable for dissolving a powder in a radioactive environment. To this end, and as is more particularly illustrated in FIG. 1, the apparatus according to the invention comprises an enclosure 10 in several parts 10*a*, 10*b*, 10*c*, parts 10*a* and 10*b* being made respectively from boron carbide and polythene in order to insulate the bowl from the neutrons and alpha particles.

The inner part 10*a* of the enclosure defines a recess 12 having a vertically axed cylindrical configuration. A rotary bowl 14 is arranged coaxially within recess 12. Bowl 14 comprises a side wall 14 sealed in its lower part by a bottom 14*b* and extended upwards by a supporting ferrule 14*c*, separated from wall 14*a* by a flange 14*d*. Supporting ferrule 14*c* is fitted in rotary manner, by means of two bearings 16, in the third part 10*c* of the enclosure, said part 10*c* being itself fixed in a larger diameter part of recess 12 formed at the upper open end of enclosure part 10*a*. Part 10*c* of the enclosure also supports a motor 18, whose vertical output shaft rotates a pinion 20, which meshes with a spur gear 22, integral with the supporting ferrule 14*c* of the bowl.

A generally cylindrical hollow member 24 is arranged coaxially within bowl 14 and rests, via a flange 24*a* which overhangs the upper open end of bowl 14, on a plate 25 fixed e.g. by screws 27 to part 10*c* of the enclosure.

The upper end of hollow member 24 is sealed by a plug 26. A not shown liquid solvent supply line passes through plug 26 or the upper side wall of cylindrical member 24, in order to issure into a solvent supply chamber 28, whose bottom is linked by openings 30 (e.g. three openings) with an annular chamber 32, defined between the outer surface of member 24 and the wall 14*a* of the bowl. More specifically, openings 30 issue into chamber 32 level with the upper end of the side wall 14*a*, i.e. to just below flange 14*d*.

As can be gathered from FIG. 1, the internal diameter of ferrule 14*c* is slightly smaller than that of bowl wall 14*a*, so that the width of annular space 33 defined between ferrule 14*c* and the outer surface of member 24 is reduced compared with that of chamber 32. The reduced width space 33 is used for continuously supplying the apparatus with powder. For this purpose a vertical supply pipe 34 issues at the upper end of space 33. Moreover, the outer surface of cylindrical member 34 is provided with an helicoidal ramp filling virtually the entire space 33 and used for entraining the powder from supply pipe 34 into the solvent introduced by openings 30. Thus, and as can be seen in FIG. 1, helicoidal ramp 36 extends over the entire height of space 33 and is then extended downwards below openings 30. For a reason which will become apparent hereinafter, this part of the screw 36 located below openings 30 is formed on a ferrule-shaped portion, 24*b* of member 24.

FIG. 1 shows that the annular chamber 32 is linked by a passage 37 made between the lower end of member 24 and the bottom 14*b* of the bowl with a second annular chamber 38 defined between the inner wall of hollow member 24 and a central pipe 40 used for removing the solution formed. Pipe 40 is arranged coaxially with respect to bowl 14 and traverses bottom 14*b* thereof, to which it is tightly fixed.

Throughout its lower part and within the ferrule-shaped portion 24*b*, member 24 has a reduced diameter. Moreover, this portion of member 24 is provided on its outer face with an helicoidal ramp 42 ensuring both the stirring of the mixture and the raising of the solution. For this purpose, the annular space 43 defined between the ferrule-shaped portion 24*b* and the reduced diameter outer surface of member 24 issues at its upper end into a central overflow 44 formed within member 24. The connection between space 43 and overflow 44 is via openings 45 (e.g. three openings). Overflow 44 is separated from openings 30 and the solvent supply chamber 28 by a partition 46. Overflow 44 is shaped like a funnel or hopper centred on the axis of bowl 14 and issuring above the upper level of central pipe 40.

The upper end of overflow 44 is connected by a pipe 49 to a circuit for removing gases evolved during dissolving. In order to condense the corrosive liquid particles entrained by these gases, the upper part of member 24 contains gas cooling means in the form of cooling circuits 48.

It is also preferable for the purpose of speeding up the dissolving action to arrange over almost the entire height of that portion of member 24 located below ferrule 24*b*, heating means in the form of heaters 50.

It is clear that the apparatus described hereinbefore with reference to FIG. 1 makes it possible to continuously dissolve a powder, whilst ensuring the removal of a substantially powder-free solution. Thus, as soon as the solvent and powder are introduced into the bowl, respectively by openings 30 and space 33, under the action of the helicoidal ramp 36, they are stirred by screw 42 carried by fixed member 24. The dissolving reaction is also sped up by heaters 50.

Bearing in mind the fact that the powder is continuously introduced, the thus obtained solution permanently contains a certain undissolved quantity of powder. Due to the centrifugal effect resulting from the rotation of bowl 14, the powder is permanently separated from the liquid phase. More specifically, this centrifugal effect is characterized in the annular chamber 32 by the fact that the denser powder tens to agglomerate along the walls of the rotary bowl 14, whilst a solution which is virtually free from solid particles only comes into contact with the outer wall of the fixed cylindrical member 24 on which is formed an helicoidal ramp 42. Bearing in mind the rotation direction of bowl 14, the winding direction of screw 42 is chosen in such a way that it tends to raise the solution along the outer wall of member 24, i.e. a substantially powder-free solution reaches the overflow 44 in order to be removed by central pipe 40, in the manner indicated by the arrows in FIG. 1.

The second embodiment of the invention shown in FIG. 2 differs from the first embodiment, on the one hand through the powder being supplied periodically by introducing soluble boxes into the solvent, and on the other through the solution being removed laterally.

Thus, it is possible to see in FIG. 2, parts 10*a*, 10*b* and 10*c*of enclosure 10, rotary bowl 14 and the fixed, hollow cylindrical member 24.

Bearing in mind the fact that the powder is introduced periodically within boxes 52 which are soluble in solvent (the boxes can in particular be made from 0.5 mm thick aluminium, the solvent being nitric acid), a recess 24*c* if formed over the entire height of the hollow member 24 and is extended upwards in the form of a cylindrical supply pipe 54, whose diameter is slightly larger than that of boxes 52. In this case, pipe 54 can also be used for introducing the solvent. In the embodiment of FIG. 2, the vertical pipe 54 and the recess 24*c* are arranged coaxially with respect to rotary bowl 14. In view of this arrangement it is virtually impossible to centrally discharge the solution as in the embodiment of FIG. 1, so that in this case the solution is removed from the side of the rotary bowl. Thus, as in the first embodiment, an helicoidal ramp 42 is provided on the outer face of cylindrical member 24. The winding direction of screw 42 is chosen in such a way as to enable the solution to rise along the outer wall of member 24, bearing in mind the rotation direction of bowl 14. However, unlike in the first embodiment, screw 42 need only be provided over a small portion of the height of member 24 in the upper part of annular chamber 32. The upper end of the helicoidal ramp 42 is extended slightly above chamber 32, within the rotary bowl supporting ferrule 14*c*. Bearing in mind that the internal diameter of ferrule 14*c* is smaller than that of wall 14*a*, an annular abutment or shoulder 56 forms an obstacle to the raising of the solution and located outside chamber 32. Screw 42 is extended beyond shoulder 56 up to lateral overflows 58 formed in a thicker portion of bowl ferrule 14*c*. The overflows 58 issue into an annular collector 60, formed in enclosure part 10*a*. At least one discharge duct 62 then carries the solution from the bottom of collector 60 to the outside of enclosure 10.

As in the first embodiment, member 24 is open at its bottom end, in such a way that its internal recess 24*c* communicates with the annular chamber 32. Furthermore, in the embodiment of FIG. 2, this opening at the lower end of member 24 is used for ensuring the stirring of the mixture in the rotary bowl. For this purpose, bowl bottom 14*b* carries vertical blades 64, which penetrate recess 24*c* of member 24. To ensure that the powder box 52 remains above the blades during its introduction, it can be supported by a perforated part 24*d* fixed to the lower end of member 24.

Apart from the link between annular chamber 32 and the space defined within recess 24*c* by the bottom of member 24, in the vicinity of the upper level of the mixture, i.e. in the vicinity of the lower end of screw 42, recycling opening 66 are provided.

As in the first embodiment, means 50 for heating the mixture and means 48 for cooling the evolved gases during dissolving can be provided.

As is indicated by the arrows in FIG. 2, the powder, solvent and solution obtained travel in a generally downward direction from openings 52 to the lower open end of member 24 within recess 24*c* formed in the latter, and upwards into the annular chamber 32. However, as in the first embodiment, the rotation of bowl 14 produces a centrifugal effect tending to agglomerate the undissolved powder along the walls of the rotary bowl within the annular chamber 32. This centrifugal effect makes it possible to remove, by means of helicoidal ramp 42, a substantially powder-free solution. Thus, the annular abutment 56 provided on the rotary bowl just below overflows 58 make it possible to ensure that the powder in the vicinity of the bowl wall does not reach the overflows 58 of the action of screw 42.

Finally, FIG. 3 shows a variant of the embodiment of FIG. 2 combining the introduction of powder in a soluble box 52 with a central removal of the solution as in the first embodiment. The apparatus of FIG. 3 otherwise has the same main components as in the previously described variants (enclosure 10, bowl 14 and member 24).

Moreover, and as in shown in FIG. 3, the pipes 54 for supplying the boxes with powder and recess 24*c* extending it within the member 24 are displaced relative to the axis of rotary bowl 14, in order to leave free the central portion of member 24 which houses, as in FIG. 1, a vertical discharge pipe 40, integral with the bowl bottom 14*b* and arranged coaxially to said bowl.

As in the first embodiment, the solvent is supplied by a supply chamber 28, formed below the plug 26 of member 24, chamber 28 being connected to the upper end of chamber 32 by openings 30. The outer surface of member 24 once again carries helicoidal ramp 42, which ensures both the stirring of the mixture in its lower part and, in its upper part, the raising of the substantially powder-free solution to overflow 44, which issues above pipe 40 and simultaneously ensures the removal of the gases formed during dissolving.

In the variant of FIG. 3, the wall of member 24 also has transverse openings 68 linking recess 24*c* and annular chamber 32 over a considerable portion of the recess height. On taking account of openings 68 enabling the powder to enter the annular chamber, the operation of the variant of FIG. 3 is substantially identical to that of the embodiment of FIG. 1.

The invention is obviously not limited to the embodiments described hereinbefore and in fact covers all variants thereof. In particular, it is possible to conceive a variant of the embodiment of FIG. 1 in which the central solution removal means are replaced by lateral removal means, as in the embodiment of FIG. 2. In this case, there could be a central supply of powder and reagent and the mixture could be stirred by means of blades integral with the bottom of the rotary bowl.

What is claimed is:

1. An apparatus for dissolving a powder in a liquid solvent, wherein it comprises a vertically axed rotary bowl, means for introducing the powder and the liquid solvent into the bowl, and a fixed cylindrical member arranged coaxially within the bowl and having on its outer face at least one first helicoidal ramp oriented with respect to the bowl rotation direction in such a way that it ensures the raising of the solution up to means ensuring the removal thereof from the bowl.

2. An apparatus according to claim 1, wherein the means for removing the solution from the bowl comprises an overflow within said member and into which the upper end of the first helicoidal ramp is positioned such that said raised solution is issued into said overflow, and a central pipe integral with the bowl and downwardly extending the overflow within the cylindrical member.

3. An apparatus according to claim 2, wherein soluble boxes containing the powder are periodically introduced at the upper end of the bowl, the means for introducing the powder comprising a recess formed in the cylindrical member.

4. An apparatus according to claim 3, wherein the vertical recess is displaced with respect to the axis of the bowl, so as to extend on the side of said central pipe, the vertical recess communicating with the annular space defined between the bowl and the cylindrical member by openings formed in the latter.

5. An apparatus according to claim 1, wherein the means for removing the solution from the bowl comprises an overflow integral with said bowl, said first helicoidal ramp having an upper end which is surrounded by and flush with said overflow, the latter issuing into an annular collector extended by at least one discharge line, the collector and the line being formed in an outer enclosure supporting the bowl.

6. An apparatus according to claim 5, wherein the soluble boxes containing the powder are introduced periodically at the upper open end of the bowl, means for introducing the powder comprising a vertical recess formed in the cylindrical member.

7. An apparatus according to claim 6, wherein the vertical recess is arranged coaxially to the bowl and communicates with the space defined between the bowl and the cylindrical member by recycling openings formed in the latter.

8. An apparatus according to claim 1, wherein the powder is continuously introduced at the upper open end of the bowl, between the latter and the cylindrical member, the means for introducing the powder comprising a second helicoidal ramp formed on the outer face of the cylindrical member, mainly above the first helicoidal ramp and oriented with respect to the rotation direction of the bowl in such a way as to ensure the descent of the powder.

9. An apparatus according to claim 1, wherein it also comprises means for heating the solution and which are located in the cylindrical member.

10. An apparatus according to claim 1, wherein it also comprises means for removing the gases which have evolved during dissolving and means for cooling these gases located in the cylindrical member.

* * * * *